US007346308B2

(12) United States Patent
Harada

(10) Patent No.: US 7,346,308 B2
(45) Date of Patent: Mar. 18, 2008

(54) CLEANING DEVICE, METHOD FOR PREPARING THE CLEANING DEVICE, AND IMAGE FORMING APPARATUS AND PROCESS CARTRIDGE USING THE CLEANING DEVICE

(75) Inventor: Hiroomi Harada, Kawasaki (JP)

(73) Assignee: Ricoh Company Limited, Tokyo (JP)

( * ) Notice: Subject to any disclaimer, the term of this patent is extended or adjusted under 35 U.S.C. 154(b) by 258 days.

(21) Appl. No.: 11/225,152

(22) Filed: Sep. 14, 2005

(65) Prior Publication Data

US 2006/0056892 A1 Mar. 16, 2006

(30) Foreign Application Priority Data

Sep. 15, 2004 (JP) ..... 2004-268229
Mar. 18, 2005 (JP) ..... 2005-078352

(51) Int. Cl.
*G03G 21/00* (2006.01)

(52) U.S. Cl. ..... 399/353; 399/349

(58) Field of Classification Search ..... 399/71, 399/123, 343, 344, 346, 349, 350, 353; 15/257.05; 401/268

See application file for complete search history.

(56) References Cited

U.S. PATENT DOCUMENTS 5,107,285 A * 4/1992 Hamada et al. ..... 347/130
5,128,725 A * 7/1992 Frankel et al. ..... 399/347
5,151,744 A * 9/1992 Lundy et al. ..... 399/71
5,463,455 A * 10/1995 Pozniakas et al. ..... 399/350
5,771,424 A * 6/1998 Lindblad et al. ..... 399/71
6,311,037 B1 * 10/2001 Hisakuni et al. ..... 399/350
6,542,713 B2 * 4/2003 Jones et al. ..... 399/343
2004/0126134 A1 7/2004 Harada et al.
2005/0063728 A1 3/2005 Harada et al.

FOREIGN PATENT DOCUMENTS

JP 03153285 A * 7/1991
JP 04238382 A * 8/1992
JP 05197317 A * 8/1993
JP 2001-166661 6/2001
JP 2001-188452 7/2001
JP 2001-235987 8/2001
JP 2001-350383 12/2001
JP 3352441 9/2002
JP 2003-5599 1/2003
JP 2003-43885 2/2003
JP 2003043888 A * 2/2003
JP 2003-233282 8/2003

* cited by examiner

*Primary Examiner*—Robert Beatty
(74) *Attorney, Agent, or Firm*—Oblon, Spivak, McClelland, Maier & Neustadt, P.C.

(57) ABSTRACT

A cleaning device including a cleaning brush configured to clean a surface of a moving member while contacting and facing the surface; and a cleaning blade which is located on a downstream side from the cleaning brush relative to a moving direction of the moving member while being substantially opposed to the cleaning brush and which is configured to clean a cleaning region of the surface of the moving member while contacting the surface of the moving member, wherein the cleaning brush contains a powder when the cleaning brush is brand-new.

24 Claims, 2 Drawing Sheets

CLEANING DEVICE, METHOD FOR PREPARING THE CLEANING DEVICE, AND IMAGE FORMING APPARATUS AND PROCESS CARTRIDGE USING THE CLEANING DEVICE

BACKGROUND OF THE INVENTION

1. Field of the Invention

The present invention relates to a cleaning device, and more particularly to a cleaning device for use in cleaning the surface of moving members in image forming apparatus. In addition, the present invention also relates to a method for preparing the cleaning device. Further, the present invention relates to an image forming apparatus and a process cartridge using the cleaning device.

2. Discussion of the Background

Image forming apparatus for use as copiers and printers typically produce images by the following method:

(1) an electrostatic latent image is formed on an image bearing member (hereinafter sometimes referred to as a photoreceptor);

(2) the electrostatic latent image is developed with a developer including a toner to visualize the latent image as a toner image;

(3) the toner image formed on the photoreceptor is transferred to a receiving material optionally via an intermediate transfer medium; and (4) the toner image is fixed on the receiving material, resulting in formation of a fixed image on the receiving material.

In such image forming apparatus, a small amount of toner particles remain on the surfaces of the photoreceptor and the intermediate transfer medium even after the toner image is transferred to a receiving material. Therefore, the image forming apparatus include one or more cleaning devices for cleaning the surface of the photoreceptor and the intermediate transfer medium. For this purpose, blade cleaning devices which remove residual toner particles while rubbing off the toner particles with a sheet (hereinafter referred to as a blade) are preferably used. Alternatively, brush cleaning devices which remove residual toner particles while scraping off the toner particles with a brush roller which is arranged so as to be rotated in pressing-contact with the photoreceptor. Recently, combination cleaning devices in which both a brush cleaning device and a blade cleaning device are arranged such that the brush cleaning device is located on an upstream side from the blade cleaning device relatively to the rotation direction of the photoreceptor are widely used.

Published unexamined Japanese patent application No. (hereinafter referred to as JP-A) 2001-188452 discloses a cleaning device in which both a brush cleaning device, which pulverizes residual toner particles to form fine toner particles, and a blade cleaning device, which scrapes off the fine toner particles, are arranged such that the brush cleaning device is located on an upstream side from the blade cleaning device relatively to the rotation direction of the photoreceptor.

JP-A 2003-043885 discloses a solid lubricant applying device which includes a brush roller and a lubricant, wherein the brush roller is contacted with both the lubricant and the photoreceptor while moving in a direction. The brush roller applies the lubricant to the surface of the photoreceptor to improve the cleanability of the photoreceptor. In this lubricant applying device, a contact member is also provided on a downstream side from the lubricant relative to the rotation direction of the brush roller such that the angle formed by a line C-A and a line C-B is greater than 180° wherein the point C is the center of the brush roller, the point A is an end point of the contact member which finally touches the brush roller and the point B is a contact point of the photoreceptor which firstly contacts the brush roller.

In addition, JP-A 2001-235987 discloses a cleaning device which includes a cleaning brush configured to rub the surface of a photoreceptor, a cleaning blade configured to scrape off residual toner particles from the surface of the photoreceptor, a flicker member configured to remove residual toner particles from the cleaning brush and a lubricant which is provided on the flicker member and which is coated on the surface of the photoreceptor by the cleaning brush; and an image forming apparatus using the cleaning device.

However, since a new cleaning brush has a strong cleaning ability, the amount of toner particles remaining on the surface of the photoreceptor is small after the surface of the photoreceptor is cleaned by such a new cleaning brush. Too small an amount of toner particles do not serve as a lubricant, and thereby the adhesion of the cleaning blade to the photoreceptor is increased, resulting occurrence of a problem (hereinafter a blade-rolling problem) in that the tip of the cleaning blade is turned by the surface of the photoreceptor so as to be bent inwardly along the surface of the photoreceptor. After repeated use, the cleaning brush contains residual toner particles in its hairs, and thereby a proper amount of toner particles are fed to the cleaning blade, resulting prevention of the blade-rolling problem mentioned above.

Because of these reasons, a need exists for cleaning device which can well clean the surface of an image bearing member without causing the blade-rolling problem whether the cleaning device is brand-new or not (i.e., or is repeatedly used).

SUMMARY OF THE INVENTION

Accordingly, an object of the present invention is to provide a cleaning device which can well clean the surface of an image bearing member without causing the blade-rolling problem whether the cleaning device is brand-new (i.e., before production of not greater than 1,000 images of A-4 size (i.e., before running of not longer than about 200 m in length)) or is repeatedly used (after production of greater than 1000 images).

Another object of the present invention is to provide a method for stably preparing the cleaning device mentioned above.

Yet another object of the present invention is to provide a process cartridge and an image forming apparatus which includes a cleaning device and which can produce high quality images without causing background development caused by the blade-rolling problem whether the cleaning device is brand-new or not (i.e., or is repeatedly used).

Briefly these objects and other objects of the present invention as hereinafter will become more readily apparent can be attained by a cleaning device including:

a cleaning brush configured to clean a surface of a moving member while contacting and facing the surface of the moving member; and a cleaning blade which is located on a downstream side from the cleaning brush relative to a moving direction of the moving member while being opposed to the cleaning brush and which is configured to clean a cleaning region of the surface of the moving member while contacting the surface of the moving member, wherein the cleaning brush contains a powder when the cleaning brush is brand-new (i.e., before use).

It is preferable that the cleaning brush contains the powder in an amount of from 3 mg/cm to 20 mg/cm in a longitudinal direction of the cleaning brush. In addition, the amount of the powder contained in an end portion of the cleaning brush in the longitudinal direction of the cleaning brush is not smaller than that contained in a central portion of the cleaning brush.

It is preferable that the cleaning brush contains the powder in the longitudinal direction thereof, wherein the length of a powder-containing portion of the cleaning brush is not shorter than the length of the cleaning region of the surface of the moving member to be cleaned by the cleaning blade, and the cleaning brush contains the powder over the entire area of the cleaning brush in the circumferential direction thereof.

The density of hairs of the cleaning brush is preferably from 5,000 pieces/inch$^2$ to 200,000 pieces/inch$^2$.

The powder is preferably a toner, which preferably has an average particle diameter not less than 4 μm. It is more preferable that the toner is a yellow toner. The toner is preferably a pulverization toner or a polymerized toner.

The powder preferably has a color substantially opposite to the color of hairs of the cleaning brush.

As another aspect of the present invention, a method for preparing a cleaning device which cleans a surface of a moving member (such as image bearing members), including:

assembling a cleaning brush and a cleaning blade such that the cleaning blade is located on a downstream side from the cleaning brush relative to a moving direction of the moving member while being opposed to the cleaning brush; and containing a powder in hairs of the cleaning brush before use.

The powder containing process can be performed before or after the assembling process.

It is preferable that the moving member is an image bearing member of an image forming apparatus and the powder is a toner.

In addition, it is preferable that the powder containing step includes:

applying a powder from the moving member to the hairs of the cleaning brush, wherein the moving member bears the powder thereon at a density of from 0.01 mg/cm$^2$ to 0.7 mg/cm$^2$.

It is preferable that the powder is applied from the moving member to the hairs of the cleaning brush in an amount of from 3 mg/cm to 20 mg/cm in the longitudinal direction of the cleaning brush. In addition, it is preferable that the length of a powder-containing portion of the cleaning brush is not shorter than the length of a cleaning region of the surface of the moving member cleaned by the cleaning blade; and the cleaning brush contains the powder over the entire area of the cleaning brush in the circumferential direction thereof. In addition, it is preferable that the amount of the powder contained in an end portion of the cleaning brush in the longitudinal direction of the cleaning brush is not smaller than that contained in a central portion of the cleaning brush.

As yet another aspect of the present invention, a process cartridge is provided which includes at least:

an image bearing member configured to bear a toner image while moving; and a cleaning device configured to clean a surface of the image bearing member after the toner image is transferred to another material, wherein the cleaning device is the cleaning device mentioned above.

As a further aspect of the present invention, an image forming apparatus is provided which includes:

an image bearing member which rotates;

a charger configured to charge the image bearing member;

a light irradiator configured to irradiate the charged image bearing member with imagewise light to form an electrostatic latent image on the image bearing member;

a developing device configured to develop the electrostatic latent image with a developer including a toner to form a toner image on the image bearing member;

a transferring device configured to transfer the toner image onto a receiving material optionally via an intermediate transfer medium; and a cleaning device configured to clean the surface of the image bearing member after the toner image is transferred, wherein the cleaning device is the cleaning device mentioned above.

It is preferable that the powder is applied from the image bearing member to the hairs of the cleaning brush in an amount of from 3 mg/cm to 20 mg/cm in the longitudinal direction of the cleaning brush. In addition, the powder is preferably a toner which is the same as or different from the toner included in the developer.

As a still further aspect of the present invention, a method for containing a powder in a brush is provided which includes:

forming a layer of the powder on a surface of a moving member; and transferring the powder on the surface of the moving member to the brush which is moved and is contacted with the moving member.

The powder is preferably a toner, and the powder layer is preferably a solid toner image formed on an image bearing member such as photoreceptors.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present inventor discovers that a proper amount of a powder such as toners and zinc stearate is previously included in a cleaning brush before use, occurrence of the above-mentioned blade-rolling problem can be prevented. Specifically, it is preferable to transfer a powder, which is present on the surface of a moving member (such as image bearing members (e.g., photoreceptors) in image forming apparatus) at a density (d) of from 0.01 to 0.7 mg/cm$^2$, to a cleaning brush in an amount (a) of from 3 to 20 mg/cm (in the longitudinal direction of the cleaning brush). In this regard, the relationship between the density (d) and the amount (a) will be explained referring to FIG. 3.

Figure 3:
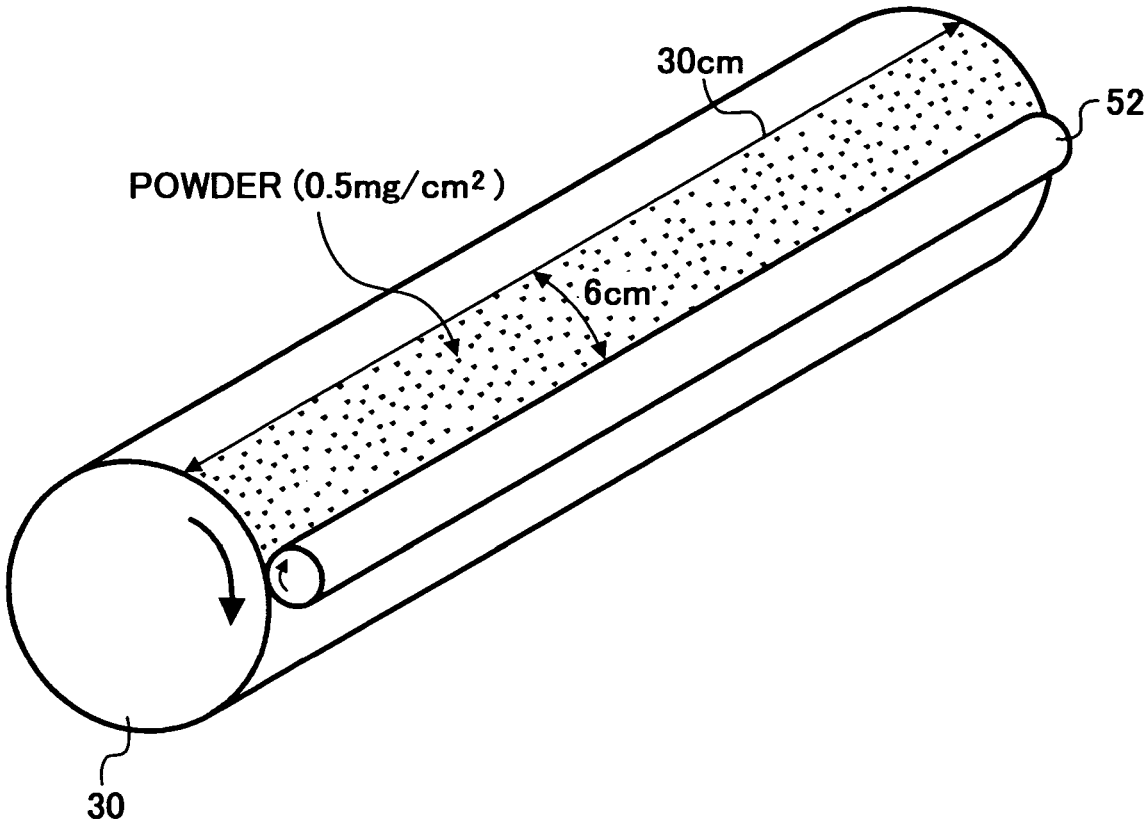
FIG. 3 is a schematic view for explaining the relationship between the density (d) of a powder and the total amount (a) of the powder to be contained in a cleaning brush.

It is assumed that a powder present on an area of a rotating member 30, which area has a length of 6 cm and a width of 30 cm, at a density (d) of 0.5 mg/cm$^2$ is transferred to a cleaning brush 52 as illustrated in FIG. 3. In this case, the amount (a) of the powder is 3 mg (0.5×6) per 1 cm in the longitudinal direction (i.e., the width direction) of the cleaning brush 52 (this amount (a) is sometimes referred to as a total amount of powder and is represented as 3 mg/cm).

When the amount (A) is too small, occurrence of the blade-rolling problem cannot be prevented. In contrast, when the amount (a) is too large, the cleaning brush has poor cleanability, and a defective cleaning problem in that toner particles remaining on an image bearing member cannot be well removed, resulting information of images with background fouling occurs.

In addition, it is preferable to control the density (d) of the powder to be input so as to be from 0.01 to 0.7 mg/cm$^2$. When the density is too low, occurrence of the blade-rolling problem cannot be prevented. In contrast, when the density (d) is too large, the cleaning brush has poor cleanability, and a defective cleaning problem in that toner particles remaining on an image bearing member cannot be well removed, resulting in formation of images with background fouling occurs.

In order to precisely control the density (d) and the amount (a) of a powder in the above-mentioned ranges, it is preferable to transfer a layer of a powder formed on a moving member to the cleaning brush. Particularly, it is more preferable to transfer a solid toner image formed on an image bearing member (such as photoreceptors) to the cleaning brush.

Then the image forming apparatus and process cartridge of the present invention will be explained referring to drawings.

Figure 1:
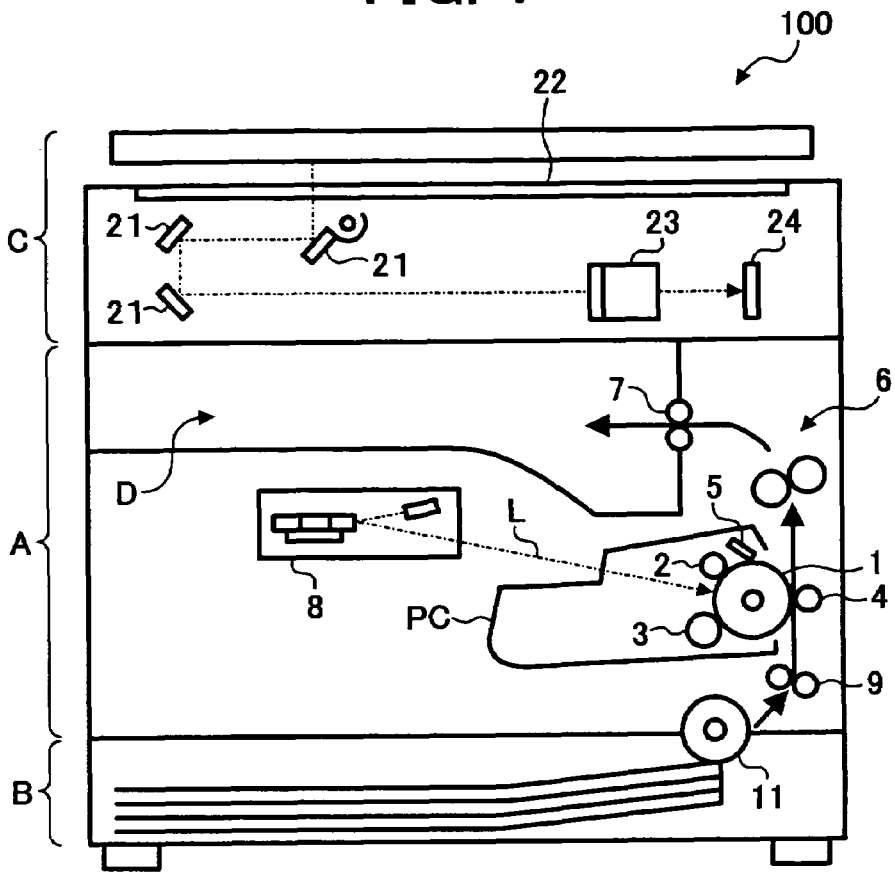
FIG. 1 is a schematic view illustrating an embodiment of the image forming apparatus of the present invention.

FIG. 1 is a schematic view illustrating an embodiment of the image forming apparatus of the present invention. An image forming apparatus 100 includes an image forming section (A); a paper feeding section (B) which is located below the image forming section (A) and which contains sheets of a receiving material; a copy stacking section (D) which is formed in the main body of the image forming apparatus 100 and which is located above the image forming section (A); and an image reading section (C) which is located above the copy stacking section (D) and which is configured to read an image of an original. Images formed on sheets of the receiving material are discharged to the copy stacking section (D) which is a space formed by the reading section (C) and the image forming section (A).

The image forming section (A) includes a photoreceptor 1 having a drum form, which serves as an image bearing member. Around the photoreceptor 1, a charger 2 configured to charge the photoreceptor 1, a light irradiator 8 configured to imagewise irradiate the charged photoreceptor with a laser beam (L) to form an electrostatic latent image on the photoreceptor 1; a developing device 3 configured to develop the electrostatic latent image with a developer including a toner to form a toner image on the photoreceptor 1; a transfer device 4 configured to transfer the toner image onto a sheet of the receiving material; and a cleaning device 5 configured to collect toner particles, which remain on the surface of the photoreceptor 1 after the image transfer process, to reuse the collected toner particles, are provided.

In recent years, a process cartridge is used for such image forming apparatus because the maintenance operation can be easily performed. As illustrated in FIG. 1, a process cartridge (PC) includes the photoreceptor 1, the cleaning device 5, the charger 2, and the developing device 3, which are unitized. The process cartridge of the present invention is not limited thereto, and includes at least an image bearing member and a cleaning member which is the cleaning device of the present invention.

The sheet of the receiving material bearing the toner image is fed to a fixing device 6 which is located on a downstream side from the transfer device 4 relative to the feeding direction of the receiving material. The sheet of the receiving material is discharged to the copy stacking section (D) by a discharging roller 7.

The paper feeding section (B) contains sheets of a receiving material. An uppermost sheet is fed from a cassette to a registration roller 9 by rotation of a feeding roller 11. The registration roller 9 stops the fed sheet once, and timely feeds the sheet such that the toner image formed on the surface of the photoreceptor 1 is transferred to a proper position of the sheet at the transfer device 4.

In the reading section (C), a reading device 21 including a light source and mirrors moves back and forth to read the image of an original (not shown) set on a glass plate 22 while scanning. The thus read image information is read by a CCD 24 through a lens 23, resulting in formation of image signals. The image signals are subjected to digitization. Then a laser diode (not shown) of the light irradiator 8 irradiates the charged photoreceptor 1 with a laser beam (L), which is modulated by the image signals and which passes through a known optical device including a polygon mirror and a lens, resulting in formation of an electrostatic latent image.

Figure 2:
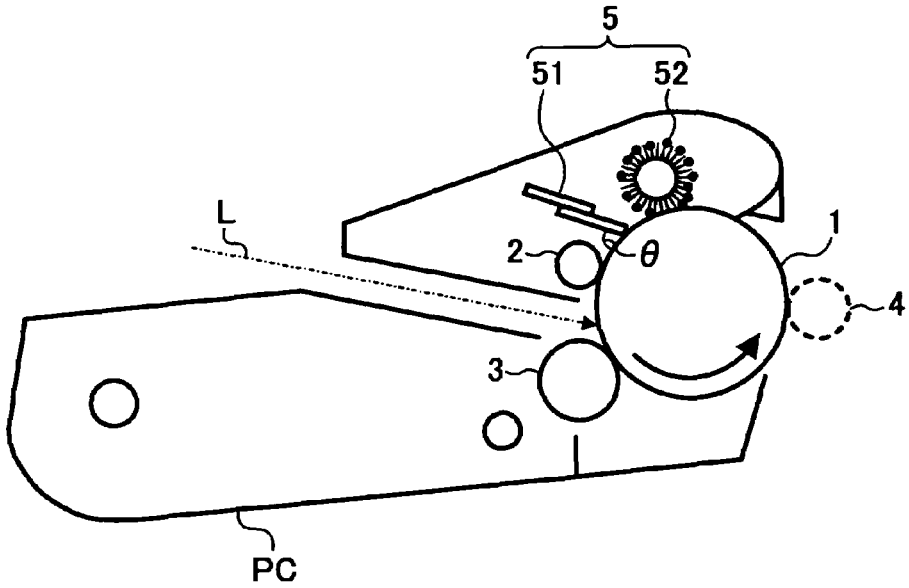
FIG. 2 is a schematic view illustrating an embodiment of the process cartridge of the present invention.

FIG. 2 is a schematic view illustrating an embodiment of the process cartridge of the present invention. In a process cartridge (PC) illustrated in FIG. 2, a photoreceptor 1, a charger 2, a developing device 3, and a cleaning device 5 are integrally incorporated in a case while the photoreceptor 1 takes a central position.

The cleaning device 5 includes a cleaning blade 51 including a urethane rubber as a main component and a cleaning brush 52 which is located on an upstream side from the cleaning blade 51 relative to the rotation direction of the photoreceptor 1. The cleaning blade 51 is set so as to counter the photoreceptor 1 and to form an angle of θ against the surface of the photoreceptor 1. Namely, the blade is set so as to extend in a direction opposite to the rotation direction of the photoreceptor 1.

By using such a process cartridge, the maintenance operation of the image forming apparatus can be easily performed. Specifically, when the image forming apparatus fails to operate properly due to the fault of a part or a device in the process cartridge, the image forming apparatus can be recovered by replacing the process cartridge. Therefore, the downtime of the image forming apparatus can be shortened.

By using the cleaning device of the present invention, the surface of the photoreceptor can be well cleaned without causing the blade-rolling problem. Therefore, the life of the photoreceptor can be prolonged.

As for the toner for use in the image forming apparatus of the present invention, pulverization toners and polymerized toners can be used.

Polymerized toners for use in the image forming apparatus are typically prepared by a method in which a toner composition liquid prepared by dispersing or dissolving a toner composition including at least a polyester prepolymer having a nitrogen-containing functional group, a polyester resin, a colorant, and a release agent in an organic solvent, and then the toner composition liquid is subjected to a crosslinking reaction and/or a molecular chain extension reaction in an aqueous medium. The toner constituents and the method for preparing the toner will be explained.

The toner for use in the image forming apparatus and process cartridge preferably includes a modified polyester resin (i). In this application, the modified polyester resin is defined as a polyester resin which has a bond other than the ester bond or which includes therein another resin component which is bonded with the polyester resin component by a covalent bond, ionic bond or other bond. Specifically, the modified polyester resin is defined as a modified polyester resin prepared by incorporating a group such as an isocyanate group, which is reactive with a carboxyl group, and a hydroxyl group, at an end portion thereof, and then reacting the group with a compound having an active hydrogen atom.

Suitable modified polyester resins for use in the toner in the present invention include urea-modified polyester resins which are prepared by reacting a polyester prepolymer (A) having an isocyanate group with an amine (B). Polyester prepolymers (A) can be prepared by a polycondensation product of a polyol (PO) and a polycarboxylic acid (PC) (i.e., a polyester resin having a group including an active hydrogen atom) with a polyisocyanate (PIC). Specific examples of the group including an active hydrogen atom include hydroxyl groups (alcoholic hydroxyl group and phenolic hydroxyl group), amino groups, carboxyl groups, mercapto groups, etc. Among these groups, the alcoholic hydroxyl group is preferable.

Suitable polyols (PO) for use in preparing the modified polyester resin include diols (DIO), polyols (TO) having three or more hydroxyl groups, and mixtures of DIO and TO. Preferably, diols (DIO) alone or mixtures of a diol (DIO) and a small amount of polyol (TO) are used.

Specific examples of the diols (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

Suitable polycarboxylic acids (PC) for use in preparing the modified polyester resin include dicarboxylic acids (DIC) and polycarboxylic acids (TC) having three or more carboxyl groups. Preferably, dicarboxylic acids (DIC) alone and mixtures of a dicarboxylic acid (DIC) with a small amount of polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

When a polycarboxylic acid (PC) is reacted with a polyol (1), anhydrides or lower alkyl esters (e.g., methyl esters, ethyl esters or isopropyl esters) of the polycarboxylic acids mentioned above can also be used as the polycarboxylic acid (PC).

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

Specific examples of the polyisocyanates (PIC) for use in preparing the modified polyester resin include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., $\alpha$, $\alpha$, $\alpha'$,$\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] group of a polyisocyanate (PIC) to the [OH] group of a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the polyisocyanate unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the resultant toner. In contrast, when the content is too high, the low temperature fixability of the toner deteriorates.

The average number of the isocyanate group included in a molecule of the polyester prepolymer (A) is generally not less than 1, preferably from 1.5 to 3, and more preferably from 1.8 to 2.5. When the average number of the isocyanate group is too small, the molecular weight of the resultant urea-modified polyester (which is crosslinked and/or extended) decreases, thereby deteriorating the hot offset resistance of the resultant toner.

The urea-modified polyester resin for use as a binder resin of the toner of the present invention can be prepared by reacting a polyester prepolymer (A) having an isocyanate group with an amine (B).

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc. Specific examples of the amino alcohols (B3) include ethanol amine, hydroxyethyl aniline, etc. Specific examples of the amino mercaptan (B4) include amino ethyl mercaptan, aminopropyl mercaptan, etc. Specific examples of the amino acids (B5) include amino propionic acid, amino caproic acid, etc. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc. Among these amines, diamines (B1) and mixtures of a diamine (B1) with a small amount of a polyamine (B2) are preferably used.

The molecular weight of the urea-modified polyesters can be controlled using a molecular chain extension inhibitor, if desired. Specific examples of the molecular chain extension inhibitor include monoamines (e.g., diethylamine, dibutyl amine, butyl amine and lauryl amine), and blocked amines (i.e., ketimine compounds) prepared by blocking the monoamines mentioned above.

The mixing ratio (i.e., the equivalence ratio [NCO]/[NHx]) of the [NCO] group of the prepolymer (A) having an isocyanate group to the [NHx] group of the amine (B) is from 1/2 to 2/1, preferably from 1/1.5 to 1.5/1 and more preferably from 1/1.2 to 1.2/1. When the mixing ratio is too low or too high, the molecular weight of the resultant urea-modified polyester decreases, resulting in deterioration of the hot offset resistance of the resultant toner.

The urea-modified polyester resins for use in the toner can include a urethane bonding as well as a urea bonding. The molar ratio of the urea bonding to the urethane bonding is from 100/0 to 10/90, preferably from 80/20 to 20/80, and more preferably from 60/40 to 30/70. When the molar ratio of the urea bonding is too low, the hot offset resistance of the resultant toner deteriorates.

The modified polyesters (i) can be prepared, for example, by a method such as one-shot methods or prepolymer methods. The weight average molecular weight of the modified polyesters (i) is generally not less than 10,000, preferably from 20,000 to 1,000,000 and more preferably from 30,000 to 1,000,000. When the weight average molecular weight is too low, the polyester resins are hardly subjected to a molecular chain extension reaction, and thereby the resultant toner has poor elasticity. As a result, the hot offset resistance of the resultant toner deteriorates. In contrast, when the molecular weight is too high, the fixability of the toner deteriorates. In addition, the productivity of the toner deteriorates, specifically, the efficiency in a granulation process or a pulverization process deteriorates.

The number average molecular weight of the modified polyester resin (i) is not particularly limited if an unmodified polyester resin (ii) is used in combination therewith. Specifically, the weight average molecular weight of the modified polyester resin is mainly controlled rather than the number average molecular weight. When the modified polyester resin is used alone, the number average molecular weight of the resin is preferably not greater than 20,000, preferably from 1,000 to 10,000, and more preferably from 2,000 to 8,000. When the number average molecular weight is too high, the low temperature fixability of the resultant toner deteriorates. In addition, when the toner is used as a color toner, the resultant toner has low glossiness.

The modified polyester resin (i) is prepared by subjecting a polyester prepolymer (A) to a crosslinking reaction and/or a molecular chain extension reaction using an amine (B). In this case, a reaction inhibitor can be used to control the molecular weight of the resultant modified polyester resin. Suitable materials for use as the reaction inhibitor include monoamines such as diethyl amine, dibutyl amine, butyl amine and lauryl amine, and blocked amines of the monoamines such as ketimine compounds.

In the present application, the molecular weight of a modified polyester resin is measured by subjecting a tetrahydrofuran solution of the resin to gel permeation chromatography (GPC).

In the present invention, it is preferable to use a combination of a modified polyester resin (i) with an unmodified polyester resin (ii) as the binder resin of the toner. By using such a combination, the low temperature fixability of the toner can be improved and in addition the toner can produce color images having a high glossiness.

Suitable materials for use as the unmodified polyester resin (ii) include polycondensation products of a polyol (PO) with a polycarboxylic acid (PC). Specific examples of the polyol (PO) and polycarboxylic acid (PC) are mentioned above for use in the modified polyester resin (i). In addition, specific examples of the suitable polyol and polycarboxylic acid are also mentioned above.

In addition, polyester resins modified by a bonding (such as urethane bonding) other than a urea bonding are considered as the unmodified polyester resin (ii) in the present application.

When a combination of a modified polyester resin (i) with an unmodified polyester resin (ii) is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (i/ii) of a modified polyester resin (i) to an unmodified polyester resin (ii) is from 5/95 to 60/40, preferably from 5/95 to 30/70, more preferably from 5/95 to 25/75, and even more preferably from 7/93 to 20/80. When the added amount of the modified polyester resin is too small, the hot offset resistance of the toner deteriorates and in addition, it is impossible to achieve a good combination of high temperature preservability and low temperature fixability.

The peak molecular weight of the unmodified polyester resin (ii) is from 1,000 to 30,000, preferably from 1,500 to 10,000 and more preferably from 2,000 to 8,000. When the peak molecular weight is too low, the high temperature preservability of the toner deteriorates. In contrast, when the peak molecular weight is too high, the low temperature fixability of the toner deteriorates.

The unmodified polyester resin (ii) preferably has a hydroxyl value not less than 5 mgKOH/g, and more preferably from 10 to 120 mgKOH/g, and even more preferably from 20 to 80 mgKOH/g. When the hydroxyl value is too small, the resultant toner has poor high temperature preservability and poor low temperature fixability.

The unmodified polyester resin (i) preferably has an acid value of from 1 to 5 mgKOH/g, and more preferably from 2 to 4 mgKOH/g. When a wax having a high acid value is used as a release agent while a resin having a relatively low acid value is used as a binder resin, good charge properties and high volume resistivity can be imparted to the toner. The thus prepared toner can be preferably used for two component developers.

The binder resin for use in the toner preferably has a glass transition temperature (Tg) of from 35 to 70° C. and more preferably from 55 to 65° C. When the glass transition temperature is too low, the high temperature preservability of the toner deteriorates. In contrast, when the glass transition temperature is too high, the low temperature fixability deteriorates. When the toner of the present invention includes a urea-modified polyester resin and an unmodified polyester resin, the toner has relatively good preservability compared to conventional toners including a polyester resin as a binder resin even when the glass transition temperature of the toner of the present invention is lower than the polyester resin included in the conventional toners. This is because the urea-modified polyester resin is typically present on a surface of toner particles.

In this application, the glass transition temperature of a resin is determined using a differential scanning calorimeter (DSC).

Colorant

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOWS, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine-Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner for use in the present invention.

Specific examples of the resins for use as the binder resin of the master batches include polymers of styrene or styrene derivatives, copolymers of styrene with a vinyl monomer, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

Charge Controlling Agent

The toner for use in the image forming apparatus of the present invention preferably includes a charge controlling agent. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. Among these materials, metal salts of salicylic acid and salicylic acid derivatives are preferably used. These materials can be used alone or in combination.

Specific examples of the marketed charge controlling agents include BONTRON® 03 (Nigrosine dye), BONTRON® P-51 (quaternary ammonium salt), BONTRON®-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPYBLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When the content is too high, the charge quantity of the toner excessively increases, and thereby the electrostatic attraction between the developing roller and the toner increases, resulting in deterioration of fluidity and decrease of image density.

Release Agent

The toner for use in the image forming apparatus of the present invention can include a release agent. Suitable release agents include waxes having a melting point of from 50 to 120° C. When such a wax is included in the toner, the wax is dispersed in the binder resin and serves as a release agent while being present at a location between a fixing roller and the toner particles in the fixing process. Thereby the hot offset problem can be avoided without applying an oil to the fixing roller used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 1,2-hydroxylstearic acid amide, stearic acid amide and phthalic anhydride imide; and low molecular weight crystalline polymers such as acrylic homopolymers and copolymers having a long alkyl group in their side chain, e.g., poly-n-stearyl methacrylate, poly-n-laurylmethacrylate and n-stearyl acrylate-ethyl methacrylate copolymers, can also be used.

The above-mentioned charge controlling agent and release agent can be kneaded with a master batch and a binder resin. Alternatively, the charge controlling agent and the release agent can be added to an organic solvent when the toner composition liquid is prepared.

External Additive

A particulate inorganic material is typically mixed with toner particles to assist in improving the fluidity, developing property and charging ability of the toner particles. It is preferable for the particulate inorganic materials to have a primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner composition.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Among these particulate inorganic materials, a combination of a hydrophobic silica and a hydrophobic titanium oxide is preferably used. In particular, when a combination of a hydrophobic silica with a hydrophobic titanium oxide each having an average particle diameter not greater than 50 nm is used as an external additive, the electrostatic force and van der Waals' force between the external additive and the toner particles can be improved, and thereby the resultant toner has a proper charge quantity. In addition, even when the toner is agitated in a developing device, the external additive is hardly released from the toner particles, and thereby image defects such as white spots and image omissions are hardly produced. Further, the quantity of particles of the toner remaining on image bearing members can be reduced.

Titanium oxide-exhibits high stability to withstand environmental conditions, and stably produce high density images. However, titanium oxide has a drawback in that the charge rising property of the toner deteriorates. Therefore it is not preferable that the content of titanium oxide is higher than that of silica. When the content of a hydrophobized titanium oxide is from 0.3 to 1.5% by weight, the charge rising property of the resultant toner hardly deteriorates. Therefore, images having good image qualities can be stably produced even when images are repeatedly produced.

Then the method for preparing the toner for use in the present invention will be explained.

(1) Preparation of Toner Composition Liquid

At first, a toner composition liquid is prepared by dissolving or dispersing toner constituents such as a colorant, an unmodified polyester resin, a prepolymer having an isocyanate group and a release agent in an organic solvent. The organic solvent is preferably a volatile solvent having a boiling point less than 100° C. so as to be easily removed from the resultant toner particles. Specific examples of such volatile solvents include toluene, xylene, benzene, carbon tetrachloride, methylenechloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The weight ratio of the solvent to the polyester prepolymer is generally from 0/100 to 300/100, preferably from 0/100 to 100/100 and more preferably from 25/100 to 75/100.

(2) Emulsification of the Toner Composition Liquid

The toner composition liquid is then dispersed in an aqueous medium in the presence of a surfactant and a particulate resin to prepare an emulsion. Suitable materials for use as the aqueous medium include water. In addition, organic solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

The weight ratio of the aqueous medium to the toner composition liquid is generally from 50/100 to 2,000/100 and preferably from 100/100 to 1,000/100. When the added amount of the aqueous medium is too low, the toner composition liquid cannot be well dispersed, and thereby toner particles having a desired particle diameter cannot be prepared. Adding a large amount of aqueous medium is not economical.

When the toner composition liquid is emulsified, a dispersant such as surfactants and particulate resins are preferably included in the aqueous medium.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, monoperfluoroalkyl(C6-C16) ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl (C6-C10)sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNIDYNE®DS-202 (from Daikin Industries, Ltd.); MEGAFACE® F-150 and F-824 (from Dainippon Ink and Chemicals, Inc.); ECTOP®EF-132 (from Tohchem Products Co., Ltd.); FUTARGENT®F-300 (from Neos); etc.

Particulate resins are added to the aqueous medium to stabilize the toner particles which are prepared in the aqueous medium. In this case, one or more particulate resins are added in an amount such that the particulate resins are present on the surface of the toner particles at a covering rate of from 10 to 90%. Specific examples of the particulate polymers include particulate methyl methacrylate having a particle diameter of 1 μm or 3 μm, particulate polystyrene having a particle diameter of 0.5 μm or 2 μm, particulate styrene-acrylonitrile copolymers having a particle diameter of 1 μm (e.g., PB-200H from Kao Corp., SPG from Soken Chemical & Engineering Co., Ltd., TECHNOPOLYMER SB from Sekisui Plastic Co., Ltd., SGP-3G from Soken Chemical & Engineering Co., Ltd., and MICROPEARL from Sekisui Chemical Co., Ltd.)

In addition, inorganic compounds can be used as a dispersant. Specific examples of the inorganic compounds include tricalciumphosphate, calcium carbonate, titanium oxide, colloidal silica, and hydroxyapatite can be preferably used.

Further, it is preferable to stabilize the emulsion or dispersion using a polymer protection colloid in combination with the particulate resins and inorganic dispersants.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

Known dispersing machines can be used for emulsifying the toner composition liquid in an aqueous medium. Suitable dispersing machines include low speed shearing dispersion machines, high speed shearing dispersion machines, friction dispersion machines, high pressure jet dispersion machines, ultrasonic dispersion machines, etc.

When high speed shearing dispersion machines are used, the rotation number of the rotor is not particularly limited, but the rotation number is generally from 1,000 to 30,000 rpm, and preferably from 5,000 to 20,000. The dispersion time is not particularly limited. When a batch dispersion machines are used, the dispersion time is generally from 0.1 to 5 minutes. The dispersion temperature is preferably from 0 to 150° C. and preferably from 40 to 98° C.

(3) Reaction of Polyester Prepolymer (A) with Amine (B)

When the toner composition liquid is added in an aqueous medium to prepare an emulsion, an amine is added to the mixture to react the amine with the polyester prepolymer having an isocyanate group. The reaction is accompanied with crosslinking and/or extension of the molecular chains of the prepolymer. The reaction time is determined depending on the reactivity of the isocyanate group of the polyester prepolymer with the amine used, and is generally from 10 minutes to 40 hours, and preferably from 2 to 24 hours. The reaction temperature is generally from 0 to 150° C., and preferably from 40 to 98° C.

In addition, known catalysts such as dibutyltin laurate and tioctyltin layrate can be used, if desired, for the reaction.

(4) Removal of Organic Solvent and Washing and Drying

After the reaction, the organic solvent is removed from the emulsion (i.e., the reaction product), followed by washing and drying. Thus, toner particles are prepared. In order to remove the organic solvent, the emulsion is gradually heated while the emulsion is agitated so as to have a laminar flow. In this case, it is preferable to remove the solvent in a certain temperature range while strongly agitating the emulsion, so that the resultant toner particles have a spindle form. When a dispersant, which can be dissolved in an acid or an alkali, such as calcium phosphate is used, it is preferable to dissolve the dispersant with hydrochloric acid to remove that from the toner particles, followed by washing. In addition, it is possible to remove such a dispersant by decomposing the dispersant using an enzyme.

(5) Addition of External Additive

Then a charge controlling agent is fixed on the thus prepared toner particles and an external additive such as particulate inorganic materials (e.g., silica and titanium oxide) is added thereto. If desired, a particulate lubricant can also be added thereto. These materials can be added by a method using a known mixer or the like.

By using such a method, a toner having a small particle diameter and a sharp particle diameter distribution can be easily prepared. By controlling the agitation during the solvent removing operation, the particle form of the toner can be easily changed from spherical forms to rugby-ball forms. In addition, the surface conditions of the toner particles can be controlled so as to have a surface of from smooth surface to rough surface like pickled plum.

When the thus prepared toner is used for the image forming apparatus of the present invention, the image forming apparatus can produce high quality images.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

A urethane rubber sheet having a thickness of 2 mm, which is manufactured by Toyo Tire & Rubber Co., Ltd., was used as a cleaning blade. The cleaning blade was set in a process cartridge so as to contact the surface of a photoreceptor at a pressure of 20±10 g/cm and a contact angle θ of 75°±10° as illustrated in FIG. 2. A brush having hairs, which are electroconductive acrylic hairs having a length of 3 mm and manufactured by Tsuchiya, was used as a cleaning brush. The cleaning brush was set on the photoreceptor so that the photoreceptor digs into the hair by 1 mm. Thus 20 pieces of the process cartridge including the photoreceptor, the cleaning blade, and the cleaning brush were prepared. A sufficient amount (i.e., from 3 mg/cm to 20 mg/cm) of a yellow toner, which had been prepared by a pulverization method and which has an average particle diameter of 6 μm, was sprinkled on the entire surface of the cleaning brushes in 10 cartridges randomly selected from the 20 cartridges.

Each of the 20 cartridges was set in an image forming apparatus IMAGIO NEO C325 manufactured by Ricoh Co., Ltd., and 1,000 white solid images were continuously produced under an environmental condition of 35° C. and 80% RH using a receiving paper of A4 size. In this case, the receiving paper was fed in a direction perpendicular to the longitudinal direction thereof.

As a result, all the ten cartridges in which the yellow toner had been sprinkled on the cleaning brush did not cause the blade-rolling problem whereas three cartridges among the ten non-treated cartridges caused the blade-rolling problem.

Example 2

A urethane rubber sheet having a thickness of 2 mm, which is manufactured by Hokushin Corp., was used as a cleaning blade. The cleaning blade was set in a process cartridge so as to contact the surface of a photoreceptor at a pressure of 60±10 g/cm and a contact angle θ of 75°±10°. A brush having hairs, which are insulation polyethylene terephthalate (PET) hairs having a length of 2.5 mm and manufactured by Tsuchiya, was used as a cleaning brush. The cleaning brush was set on the photoreceptor so that the photoreceptor digs into the hair by 0.5 mm. Thus, 20 pieces of the process cartridge including the photoreceptor, the cleaning blade, and the cleaning brush were prepared. A sufficient amount (i.e., from 3 mg/cm to 20 mg/cm) of a calcium stearate powder having an average particle diameter of 5 μm was sprinkled on the entire surface of the cleaning brushes in 10 cartridges randomly selected from the 20 cartridges.

Each of the 20 cartridges was set in an image forming apparatus IMAGIO NEO C325 manufactured by Ricoh Co., Ltd., and 1,000 white solid images were continuously produced under an environmental condition of 35° C. and 80% RH using a receiving paper of A4 size. In this case, the receiving paper was fed in a direction perpendicular to the longitudinal direction thereof.

As a result, all the ten cartridges in which calcium stearate had been sprinkled on the cleaning brush did not cause the blade-rolling problem whereas three cartridges among the ten non-treated cartridges caused the blade-rolling problem.

Example 3

A urethane rubber sheet having a thickness of 2 mm, which is manufactured by Bando Chemical Industries, Ltd., was used as the cleaning blade. The cleaning blade was set in a process cartridge so as to contact the surface of a photoreceptor at a pressure of 25±10 g/cm and a contact angle θ of 72°±10°. A brush having hairs, which are made of electroconductive nylon hairs having a length of 3 mm and which is manufactured by Toei Sangyo, was used as the cleaning brush. The cleaning brush was set on the photoreceptor so that the photoreceptor digs into the hair by 1 mm. Thus, 20 pieces of the process cartridge including the photoreceptor, the cleaning blade, and the cleaning brush were prepared. A sufficient amount (i.e., from 3 mg/cm to 20 mg/cm) of a zinc stearate powder having an average particle diameter of 5 μm was sprinkled on the entire surface of the cleaning brushes in 10 cartridges randomly selected from the 20 cartridges.

Each of the 20 cartridges was set in an image forming apparatus IMAGIO NEO C325 manufactured by Ricoh Co., Ltd., and 1,000 white solid images were continuously produced under an environmental condition of 35° C. and 80% RH using a receiving paper of A4 size. In this case, the receiving paper was fed in a direction perpendicular to the longitudinal direction thereof.

As a result, all the zinc stearate sprinkled cartridges did not cause the blade-rolling problem whereas two cartridges among the ten non-treated cartridges caused the blade-rolling problem.

It is clear from Examples 1-3 that by sprinkling a predetermined amount of a powder on a brad-new cleaning brush, the blade-rolling problem can be avoided. In addition, it was found that by sprinkling a predetermined amount of a powder on a portion of the brush such that the portion has a length in the longitudinal direction thereof not shorter than the width of the cleaning region of the cleaning blade while sprinkling the powder in the entire surface of the brush in the moving direction of the cleaning brush, occurrence of the blade-rolling problem can be prevented.

When a toner is used, the powder sprinkling operation can be easily performed. Particularly, when a yellow toner is used and if the yellow toner is adhered to the background area of images, the yellow toner adhered to the background area of images is hardly visible on a white paper, and therefore the background development problem is not caused.

By using a powder (such as toner) having a color opposite to that of the hairs of the brush, it is easily found visibly whether or not a powder is sprinkled on the cleaning brush, for example, in a process cartridge assembling process in a factory. In addition, by using a pulverization toner having an average particle diameter not less than 4 μm, the toner hardly passes through the cleaning blade, and thereby formation of images whose background area is soiled with the toner can be securely prevented.

Example 4

A urethane rubber sheet having a thickness of 2 mm, which is manufactured by Toyo Tire & Rubber Co., Ltd., was used as a cleaning blade. The cleaning blade was set in a process cartridge so as to contact the surface of a photoreceptor at a pressure of 20±10 g/cm and a contact angle θ of 75°±10°. A brush having hairs, which are electroconductive acrylic hairs having a length of 3 mm and manufactured by Tsuchiya, was used as the cleaning brush. The cleaning brush was set on the photoreceptor so that the photoreceptor digs into the hair by 1 mm. Thus several process cartridges each including the photoreceptor, the cleaning blade, and the cleaning brush were prepared.

Each of the cartridges was set in an image forming apparatus IMAGIO NEO C325 manufactured by Ricoh Co., Ltd., to contain a powder in the cleaning brush. Specifically, a yellow toner which had been prepared by a pulverization method and which has an average particle diameter of 6 μm was transferred from the surface of the photoreceptor of the image forming apparatus to the entire surface of the cleaning brushes while the density (d) of the yellow toner present on the surface of the photoreceptor was changed as shown in Table 1 to determine whether the blade-rolling problem occurs when the powder is contained in the cleaning brush.

The results are shown in Table 1.

TABLE 1

| | Amount of toner (mg/cm$^2$) | | | | | | | | |
|---|---|---|---|---|---|---|---|---|---|
| | 0.005 | 0.01 | 0.02 | 0.1 | 0.2 | 0.5 | 0.7 | 0.8 | 1.0 |
| Problem | Yes* | No | No | No | No | No | No | Yes** | Yes** |

Yes*: The blade-rolling problem occurred.
Yes**: A defective cleaning problem in that the residual toner cannot be well removed from the surface of the photoreceptor, resulting in formation of images whose background area is soiled with the toner occurred.

It is clear from Table 1 that when the density (d) of the yellow toner transferred is from 0.01 to 0.7 mg/cm$^2$, the surface of the photoreceptor can be well cleaned without causing any problems.

Example 5

A urethane rubber sheet having a thickness of 2 mm, which is manufactured by Hokushin Corp. was used as a cleaning blade. The cleaning blade was set in a process cartridge so as to contact the surface of a photoreceptor at a pressure of 60±10 g/cm and a contact angle θ of 75°±10°. A brush having hairs, which are insulation PET hairs having a length of 2.5 mm and manufactured by Tsuchiya, was used as a cleaning brush. The cleaning brush was set on the photoreceptor so that the photoreceptor digs into the hair by 0.5 mm. Thus several process cartridges each including the photoreceptor, the cleaning blade, and the cleaning brush were prepared.

Each of the cartridges was set in an image forming apparatus IMAGIO NEO C325 manufactured by Ricoh Co., Ltd., to contain a powder in the cleaning brush. Specifically, a yellow toner which had been prepared by a pulverization method and which has an average particle diameter of 6 μm was transferred from the surface of the photoreceptor on the entire surface of the cleaning brushes while the density (d) of the yellow toner present on the surface of the photoreceptor was changed as shown in Table 2 to determine whether the blade-rolling problem occurs when the powder is contained in the cleaning brush.

The results are shown in Table 2.

TABLE 2

| | Amount of toner (mg/cm$^2$) | | | | | | | | |
|---|---|---|---|---|---|---|---|---|---|
| | 0.005 | 0.01 | 0.02 | 0.1 | 0.2 | 0.5 | 0.7 | 0.8 | 1.0 |
| Problem | Yes* | No | No | No | No | No | No | Yes** | Yes** |

Yes*: The blade-rolling problem occurs.
Yes**: A defective cleaning problem in that the residual toner cannot be well removed from the surface of the photoreceptor, resulting in formation of images whose background area is soiled with the toner occurs.

It is clear from Table 2 that when the density (d) of the yellow toner transferred is from 0.01 to 0.7 mg/cm$^2$, the surface of the photoreceptor can be well cleaned without causing any problems.

Example 6

A urethane rubber sheet having a thickness of 2 mm, which is manufactured by Bando Chemical Industries, Ltd., was used as a cleaning blade. The cleaning blade was set in a process cartridge so as to contact the surface of a photoreceptor at a pressure of 25±10 g/cm and a contact angle θ of 72°±10°. A brush having hairs, which are electroconductive nylon hairs having a length of 3 mm and manufactured by Tsuchiya, was used as the cleaning brush. The cleaning brush was set on the photoreceptor so that the photoreceptor digs into the hair by 1 mm. Thus several process cartridges each including the photoreceptor, the cleaning blade, and the cleaning brush were prepared. A black toner which had been prepared by a pulverization method and which has an average particle diameter of 5.5 μm and which is present on the photoreceptor at a density of 0.5 mg/cm$^2$ was transferred from the surface of the photoreceptor to the entire surface of the cleaning brushes while the total amount of the toner included in the hairs of the cleaning brush was changed from 0.1 mg/cm to 30 mg/cm as shown in Table 3.

Each of the cartridges was set in an image forming apparatus IMAGIO NEO C325 manufactured by Ricoh Co., Ltd., and 1,000 white solid images were continuously produced under an environmental condition of 35° C. and 80% RH using a receiving paper of A4 size to determine whether any problem occurs. In this case, the receiving paper was fed in a direction perpendicular to the longitudinal direction thereof.

In addition, each of the cartridges was set in an image forming apparatus IMAGIO NEO C325 manufactured by Ricoh Co., Ltd., and 1,000 copies of an image with an image area proportion of 10% were continuously produced under an environmental condition of normal temperature and normal humidity using a receiving paper of A4 size to determine whether any problem occurs.

The results are shown in Table 3.

TABLE 3

| | Total amount of toner (mg/cm) | | | | | | | | |
|---|---|---|---|---|---|---|---|---|---|
| | 1.0 | 2.0 | 3.0 | 4.0 | 5.0 | 10 | 20 | 25 | 30 |
| Problem (35° C./80% RH) | Yes* | Yes* | No | No | No | No | No | No | No |
| Problem (normal temp./normal humidity) | No | No | No | No | No | No | No | Yes** | Yes** |

Yes*: The blade-rolling problem occurred.
Yes**: A defective cleaning problem in that the residual toner cannot be well removed from the surface of the photoreceptor, resulting in formation of images whose background area is soiled with the toner occurred.

It is clear from Table 3 that when the total amount of the toner sprinkled is from 3 to 20 mg/cm, the surface of the photoreceptor can be cleaned without causing any problems.

Example 7

A urethane rubber sheet having a thickness of 2 mm, which is manufactured by Toyo Tire & Rubber Co., Ltd., was used as a cleaning blade. The cleaning blade was set in a process cartridge so as to contact the surface of a photoreceptor at a pressure of 20±10 g/cm and a contact angle θ of 75°±10°. Plural brushes having hairs, which are electroconductive acrylic hairs having a length of 3 mm and manufactured by Tsuchiya and whose density is changed from 1,000 to 250,000 hairs/inch as shown in Table 4, were used as a cleaning brush. Each of the cleaning brushes was set on the photoreceptors in the same process cartridges so that the photoreceptor digs into the hair by 1 mm. Thus several process cartridges each including the photoreceptor, the cleaning blade, and one of the cleaning brushes were prepared. A sufficient amount (i.e., from 3 to 20 mg/cm) of a yellow toner, which had been prepared by a pulverization method and which has an average particle diameter of 6 μm, was sprinkled on the entire surface of the cleaning brushes.

Each of the cartridges was set in an image forming apparatus IMAGIO NEO C325 manufactured by Ricoh Co., Ltd., and 1,000 white solid images were continuously produced under an environmental condition of 35° C. and 80% RH using a receiving paper of A4 size to determine whether any problem occurs. In this case, the receiving paper was fed in a direction perpendicular to the longitudinal direction thereof.

In addition, each of the cartridges was set in an image forming apparatus IMAGIO NEO C325 manufactured by Ricoh Co., Ltd., and 1,000 white solid images were continuously produced under an environmental condition of 45° C. and 80% RH using a receiving paper of A4 size to determine whether any problem occurs.

Further, each of the cartridges was set in an image forming apparatus IMAGIO NEO C325 manufactured by Ricoh Co., Ltd., and 1,000 copies of an image with an image area proportion of 10% were continuously produced under an environmental condition of normal temperature and normal humidity using a receiving paper of A4 size to determine whether any problem occurs.

The results are shown in Table 4.

TABLE 4

| | Density of hair ($10^3$ pieces/inch) | | | | | | | | |
|---|---|---|---|---|---|---|---|---|---|
| | 1 | 3 | 5 | 10 | 50 | 100 | 150 | 200 | 250 |
| Problem (35° C./80% RH) | Yes* | Yes* | No | No | No | No | No | No | No |
| Problem (45° C./80% RH) | No | No | No | No | No | No | No | No | Yes** |
| Problem (normal temp./normal humidity) | No | No | No | No | No | No | No | No | Yes$^3$* |

Yes*: The blade-rolling problem occurred.
Yes**: A problem in that the hairs are clogged with the toner particles, resulting in occurrence of defective cleaning occurred.
Yes$^3$*: A defective cleaning problem in that the residual toner cannot be well removed from the surface of the photoreceptor, resulting in formation of images whose background area is soiled with the toner occurred.

It is clear from Table 4 that when the density of hairs is from 5,000 hairs/inch to 200,000 hairs/inch, the surface of the photoreceptor can be well cleaned without causing any problems.

Example 8

A urethane rubber sheet having a thickness of 2 mm, which is manufactured by Hokushin Corp., was used as a cleaning blade. The cleaning blade was set in a process cartridge so as to contact the surface of a photoreceptor at a pressure of 60±10 g/cm and a contact angle θ of 75°±10°. Several brushes having hairs, which are insulation PET hairs having a length of 2.5 mm and manufactured by Tsuchiya and whose density is changed from 1,000 to 250,000 hairs/ inch, were used as the cleaning brush. Each of the cleaning brush was set on the photoreceptor so that the photoreceptor digs into the hair by 0.5 mm. Thus several process cartridges each including the photoreceptor, the cleaning blade, and one of the cleaning brushes were prepared. A sufficient amount (i.e., from 3 to 20 mg/cm) of a calcium stearate powder having an average particle diameter of 5 μm was sprinkled on the entire surface of the cleaning brushes.

Each of the cartridges was set in an image forming apparatus IMAGIO NEO C325 manufactured by Ricoh Co., Ltd., and 1,000 white solid images were continuously produced under an environmental condition of 35° C. and 80% RH using a receiving paper of A4 size to determine whether any problem occurs. In this case, the receiving paper was fed in a direction perpendicular to the longitudinal direction thereof.

In addition, each of the cartridges was set in an image forming apparatus IMAGIO NEO C325 manufactured by Ricoh Co., Ltd., and 1,000 white solid images were continuously produced under an environmental condition of 45° C. and 80% RH using a receiving paper of A4 size to determine whether any problem occurs.

Further, each of the cartridges was set in an image forming apparatus IMAGIO NEO C325 manufactured by Ricoh Co., Ltd., and 1,000 copies of an image with an image area proportion of 10% were continuously produced under an environmental condition of normal temperature and normal humidity using a receiving paper of A4 size to determine whether any problem occurs.

The results are shown in Table 5.

TABLE 5

| | Density of hair ($10^3$ pieces/inch) | | | | | | | | |
|---|---|---|---|---|---|---|---|---|---|
| | 1 | 3 | 5 | 10 | 50 | 100 | 150 | 200 | 250 |
| Problem (35° C./80% RH) | Yes* | Yes* | No | No | No | No | No | No | No |
| Problem (45° C./80% RH) | No | No | No | No | No | No | No | No | Yes** |
| Problem (normal temp./normal humidity) | No | No | No | No | No | No | No | No | Yes$^3$* |

Yes*: The blade-rolling problem occurred.
Yes**: A problem in that the hairs are clogged with the toner particles, resulting in occurrence of defective cleaning occurred.
Yes$^3$*: A defective cleaning problem in that the residual toner cannot be well removed from the surface of the photoreceptor, resulting in formation of images whose background area is soiled with the toner occurred.

It is clear from Table 5 that when the density of hairs is from 5,000 hairs/inch to 200,000 hairs/inch, the surface of the photoreceptor can be well cleaned without causing any problems.

This document claims priority and contains subject matter related to Japanese Patent Applications Nos. 2004-268229 and 2005-078352, filed on Sep. 15, 2004, and Mar. 18, 2005, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A cleaning device comprising:

a cleaning brush configured to clean a surface of a moving member while contacting and facing the surface of the moving member, the cleaning brush containing a powder when the cleaning brush is brand-new; and a cleaning blade which is located on a downstream side from the cleaning brush relative to a moving direction of the moving member while being opposed to the cleaning brush and which is configured to clean a cleaning region of the surface of the moving member while contacting the surface of the moving member, wherein the cleaning brush contains the powder in an amount of from 3 mg/cm to 20 mg/cm in a longitudinal direction of the cleaning brush.

2. The cleaning device according to claim 1, wherein an amount of the powder contained in an end portion of the cleaning brush in a longitudinal direction of the cleaning brush is not smaller than that contained in a central portion of the cleaning brush.

3. The cleaning device according to claim 1, wherein a length of a powder-containing portion of the cleaning brush is not shorter than a length of the cleaning region of the surface of the moving member to be cleaned by the cleaning blade.

4. The cleaning device according to claim 1, wherein the cleaning brush contains the powder over an entire area of the cleaning brush in a circumferential direction thereof.

5. The cleaning device according to claim 1, wherein a density of hairs of the cleaning brush is from 5,000 pieces/inch$^2$ to 200,000 pieces/inch$^2$.

6. The cleaning device according to claim 1, wherein the powder is a toner.

7. The cleaning device according to claim 6, wherein the toner has an average particle diameter not less than 4 μm.

8. The cleaning device according to claim 6, wherein the toner is a yellow toner.

9. The cleaning device according to claim 6, wherein the toner has a color substantially opposite to a color of hairs of the cleaning brush.

10. The cleaning device according to claim 6, wherein the toner is a member selected from the group consisting of pulverization toners and polymerized toners.

11. A method for preparing a cleaning device which cleans a surface of a moving member, comprising:

assembling a cleaning brush and a cleaning blade such that the cleaning blade is located on a downstream side from the cleaning brush relative to a moving direction of the moving member while being opposed to the cleaning brush; and applying a powder to hairs of the cleaning brush in an amount of from 3 mg/cm to 20 mg/cm in a longitudinal direction of the cleaning brush before use.

12. The method according to claim 11, wherein the applying step further comprises:

applying the powder from the moving member to hairs of the cleaning brush.

13. The method according to claim 12, wherein the moving member bears the powder thereon at a density of from 0.01 mg/cm$^2$ to 0.7 mg/cm$^2$.

14. The method according to claim 11, wherein a length of a powder-containing portion of the cleaning brush is not shorter than a length of a cleaning region of the surface of the moving member cleaned by the cleaning blade.

15. The method according to claim 11, wherein the applying step further comprises:

providing the cleaning brush with the powder over an entire area of the cleaning brush in a circumferential direction thereof.

16. The method according to claim 11, wherein the applying step further comprises:

providing an amount of the powder in an end portion of the cleaning brush in a longitudinal direction of the cleaning brush that is not smaller than an amount contained in a central portion of the cleaning brush.

17. The method according to claim 11, wherein the moving member is an image bearing member of an image forming apparatus and the powder is a toner.

18. A process cartridge comprising:

an image bearing member configured to bear a toner image while moving in a direction; and a cleaning device configured to clean a surface of the image bearing member after the toner image is transferred to a receiving material, the cleaning device including a cleaning brush configured to clean the surface of the image bearing member while contacting and facing the surface of the image bearing member, wherein the cleaning brush contains a powder when the cleaning brush is brand-new, and the powder is applied to hairs of the cleaning brush from the image bearing member in an amount of from 3 mg/cm to 20 mg/cm in the longitudinal direction of the cleaning brush, and a cleaning blade which is located on a downstream side from the cleaning brush relative to the moving direction of the image bearing member while being opposed to the cleaning brush and which is configured to clean a cleaning region of the surface of the image bearing member while contacting the surface.

19. The process cartridge according to claim 18, wherein the powder is a toner which is the same as or different from the toner constituting of the toner image.

20. An image forming apparatus comprising:

an image bearing member configured to move in a direction;

a charger configured to charge the image bearing member;

a light irradiator configured to irradiate the charged image bearing member with imagewise light to form an electrostatic latent image on the image bearing member;

a developing device configured to develop the electrostatic latent image with a developer including a toner to form a toner image on the image bearing member;

a transferring device configured to transfer the toner image onto a receiving material via an intermediate transfer medium; and a cleaning device configured to clean the surface of the image bearing member after the toner image is transferred, the cleaning device including a cleaning brush configured to clean the surface of the image bearing member while contacting and facing the surface, wherein the cleaning brush contains a powder when the cleaning brush is brand-new, and the powder is applied to hairs of the cleaning brush from the image bearing member in an amount of from 3 mg/cm to 20 mg/cm in the longitudinal direction of the cleaning brush, and a cleaning blade which is located on a downstream side from the cleaning brush relative to the moving direction of the image bearing member while being opposed to the cleaning brush and which is configured to clean a cleaning region of the surface of the image bearing member while contacting the surface of the image bearing member.

21. The image forming apparatus according to claim 20, wherein the powder is a toner which is the same as or different from the toner included in the developer.

22. A method for containing a powder in a brush, comprising:

forming a layer of the powder on a surface of a moving member; and transferring the powder on the surface of the moving member to the brush in an amount of from 3 mg/cm to 20 mg/cm in a longitudinal direction of the brush where the brush is moved and is contacted with the moving member.

23. The method according to claim 22, wherein the powder is a toner and the forming step comprises:

forming a solid image of the toner on a surface of a moving image bearing member.

24. The method according to claim 23, wherein the solid image of the toner has a weight of from 0.01 to 0.7 mg/cm$^2$.

* * * * *